US008479464B2

(12) United States Patent
Holzworth

(10) Patent No.: US 8,479,464 B2
(45) Date of Patent: Jul. 9, 2013

(54) MODULAR AND PORTABLE TARGET RANGE SHELTER

(76) Inventor: Leonard Holzworth, Laguna Beach, CA (US)

( * ) Notice: Subject to any disclaimer, the term of this patent is extended or adjusted under 35 U.S.C. 154(b) by 90 days.

(21) Appl. No.: 12/713,086

(22) Filed: Feb. 25, 2010

(65) Prior Publication Data

US 2010/0293868 A1 Nov. 25, 2010

Related U.S. Application Data

(60) Provisional application No. 61/155,822, filed on Feb. 26, 2009.

(51) Int. Cl.
*F41J 3/00* (2006.01)
*F41J 1/01* (2006.01)

(52) U.S. Cl.
USPC ..... 52/284; 52/285.1; 52/285.4; 273/408; 273/403

(58) Field of Classification Search
USPC ..... 52/284, 285.1, 285.4, 285.2, 409, 52/411–412, 309.7, 309.16, 272; 89/36.02, 89/36.01, 36.11; 273/408, 403, 305
See application file for complete search history.

(56) References Cited

U.S. PATENT DOCUMENTS

| | | | | | |
|---|---|---|---|---|---|
| 1,990,656 | A | * | 2/1935 | Kotrbaty | 52/243 |
| 3,509,016 | A | * | 4/1970 | Wickersham, Jr. et al. | 220/560.02 |
| 3,512,778 | A | * | 5/1970 | Allen | 273/403 |
| 3,685,830 | A | * | 8/1972 | Holm | 273/348 |
| 4,076,246 | A | | 2/1978 | Meyer | |
| 4,082,280 | A | * | 4/1978 | Lang | 273/408 |
| 4,121,959 | A | | 10/1978 | Meyer | |
| 4,235,444 | A | * | 11/1980 | Meyer | 273/403 |
| 4,494,348 | A | * | 1/1985 | Kastelic | 52/588.1 |
| 4,659,089 | A | * | 4/1987 | Rosa | 273/348.1 |
| 4,810,561 | A | * | 3/1989 | King | 428/195.1 |
| 4,822,657 | A | * | 4/1989 | Simpson | 428/69 |
| 5,002,285 | A | * | 3/1991 | Morrell | 273/408 |
| 5,200,256 | A | * | 4/1993 | Dunbar | 428/212 |
| 5,486,425 | A | * | 1/1996 | Seibert | 428/500 |
| 5,577,734 | A | * | 11/1996 | Conroy | 273/407 |
| 5,924,694 | A | * | 7/1999 | Kent | 273/408 |
| 6,009,673 | A | | 1/2000 | Adams | |

(Continued)

FOREIGN PATENT DOCUMENTS

JP 51099898 9/1976

OTHER PUBLICATIONS

The International Searching Authority, Written Opinion, Jun. 28, 2012, 5 pages, Korea.

(Continued)

*Primary Examiner* — Phi A
(74) *Attorney, Agent, or Firm* — Marc E. Hankin; Kevin Schraven; Hankin Patent Law, APC

(57) ABSTRACT

The invention is a portable and modular shelter that are assembled and erected to serve as a background or expendable facade for range targets used in live ammunition target practice and combat exercises. The panels of the modular and portable shelter are ballistically designed to let rounds of ammunition pass through with as little damage to the panels as possible. Additionally, the panels do not cause the ballistic projectiles passing through to scatter, splashback, or ricochet. The modular and portable shelters have no lasting environmental impact if erected temporarily.

15 Claims, 8 Drawing Sheets

U.S. PATENT DOCUMENTS

| | | | | |
|---|---|---|---|---|
| 6,286,269 | B1 | 9/2001 | Marcum | |
| 6,493,995 | B2 | 12/2002 | McKenzie | |
| 6,543,371 | B1 * | 4/2003 | Gardner | 109/83 |
| 6,568,310 | B2 * | 5/2003 | Morgan | 89/36.02 |
| 6,698,149 | B1 * | 3/2004 | Ruchgy | 52/309.4 |
| 6,703,104 | B1 * | 3/2004 | Neal | 428/118 |
| 6,708,462 | B2 * | 3/2004 | Pokorzynski et al. | 52/716.5 |
| 6,863,970 | B2 * | 3/2005 | Novak | 428/309.9 |
| 7,357,394 | B2 | 4/2008 | Halverson | |
| 7,886,651 | B2 * | 2/2011 | Hall | 89/36.02 |
| 7,897,235 | B1 * | 3/2011 | Locher et al. | 428/76 |
| 7,934,349 | B1 * | 5/2011 | Romig | 52/653.1 |
| 8,015,768 | B2 * | 9/2011 | Frejowski | 52/309.4 |
| 2003/0096072 | A1 * | 5/2003 | Johnson | 428/36.91 |
| 2006/0107985 | A1 | 5/2006 | Sovine | |
| 2007/0113487 | A1 | 5/2007 | Warminsky | |

OTHER PUBLICATIONS

The International Searching Authority, International Search Report, Jun. 28, 2012, 3 pages, Korea.

The International Bureau, International Preliminary Report on Patentability, Aug. 28, 2012, 6 pages, Korea.

The International Searching Authority, Notification of Transmittal of the International Search Report and the Written Opinion of the International Searching Authority, Jun. 28, 2012, 2 pages, Korea.

* cited by examiner

MODULAR AND PORTABLE TARGET RANGE SHELTER

CROSS-REFERENCE TO RELATED APPLICATIONS

This application claims priority from U.S. Provisional Application No. 61/155,822, filed on Feb. 26, 2009, entitled "Sustainable Range Shelter," to inventor Leonard Holzworth, the contents of which are expressly incorporated by this reference as though set forth in full herein.

FIELD OF THE INVENTION

This invention relates to portable modular structures or shelters that are erected to serve as range targets for live ammunition target practice and combat exercises. The modular shelters, or expendable facades, of this invention are ballistically designed to let rounds of ammunition pass through the walls, floors, and ceilings of the shelter with as little damage as possible. Additionally, the modular shelters are designed to have no lasting environmental impact when erected temporarily.

BACKGROUND OF THE INVENTION

Target or range shelters are used to simulate houses or other shelters that may be fired at during the course of a military training exercise. Because the shelters will be hit by hundreds or thousands of rounds of live ammunition the range shelters are, by there very nature, temporary shelters. The prior art includes several different types of range shelters. One of the most common type of range shelters is the wood shelter that is primarily made of prefabricated plywood panels. Although the wood panels are relatively light and somewhat replaceable, they also have many draw backs, including that they are easily damaged by the live ammunition, and so must be replaced frequently, are a serious fire hazard, violently splinter, cause the bullets to scatter, splashback, or ricochet, and can be costly to clean up.

Another type of range shelter is the type that is designed to actually stop bullets. An example of this type of range shelter, called a bullet containment shelter, is disclosed by United States Published Patent Application No. 2006/0107985, filed by Sovine. Sovine discloses a modular shoot house facility with panels that are specifically designed to not let bullets pass through. United States Published Patent Application No. 2007/0113487, filed by Warminsky discloses another type of bullet containment range shelter. This type of bullet containment range shelter is useful if the range shelter will actually be entered by a shooter during target practice.

Regarding temporary structures that are generally related to shooting and other gun related sports, U.S. Pat. No. 7,357,394 issued to Halverson discloses a portable and modular shooting range. Importantly, Halverson does not disclose a building that itself is meant to take fire, rather, the users fires at targets when both the user and the targets are inside the building.

U.S. Pat. No. 6,009,673, issued to Adams and U.S. Pat. No. 6,286,269, issued to Marcum, disclose a modular paneled structure that is erected for the purpose of serving as a hunting blind. Adams discloses that the panels may be made from a metallic skin with expanded polystyrene so that the panels act as insulators to keep the hunter using them warm. However, Adams does not disclose that the panels may be made from polyurethane or that the panels take fire from live ammunition.

Regarding range targets which are specifically designed to allow live ammunition to pass through without causing too much damage to the target, U.S. Pat. No. 5,486,425, issued to Seibert, discloses a "target for firearm projectiles including a body of an ionomeric material comprising a metallic salt of a copolymer of ethylene and a vinyl monomer having an acidic group, said body being operable, when penetrated by a bullet to first stretch and deform and then to form an opening therethrough which reseals after the bullet has passed and including a target support structure for retaining said body of ionomeric material." An ionomeric material is mixture of glass and an organic acid. Although Seibert discloses an ammunition target that is designed to allow a projectile to pass through the target, Seibert utterly fails to disclose a range "shelter" that is made from a pass through material and fails to disclose that the pass through material is made from aluminum or galvanized steel and polyurethane.

Additionally, one of the above shelters and targets take into consideration the damage that they do to the environment. For example, the typical wood prior art range, when it is utterly destroyed by the ammunition, or when it is removed, leaves an environmentally unfriendly footprint. Seibert is not environmentally friendly because it is made out of an ionomeric material.

Thus, what is needed is an environmentally friendly, portable, modular, and light weight range shelter, which is easy to install and remove and that allows ammunition to pass through its panels with minimal damage to the shelter, and which does not ricochet or splashback the projectiles.

SUMMARY OF THE INVENTION

To minimize the limitations in the prior art, and to minimize other limitations that will become apparent upon reading and understanding the present specification, the present invention discloses a portable modular shelter or structure that is assembled or erected to serve as a range target, expendable facade, or a background for a range targets during live ammunition target practice and combat exercises. The modular shelter of this invention is ballistically designed to let rounds of ammunition pass through the walls, floors, and ceilings of the shelter with as little damage as possible. Additionally, the modular shelters are designed to have no lasting environmental impact when erected temporarily. The shelter is designed so there are no eves for birds or other animals to nest in and it is preferably suspended on floor blocks approximately 1-100 centimeters above ground so as to not leave a large and damaging footprint after it is taken down. The raised floor also is allows small animals to pass under the structure un-disturbed. Because of its temporary nature the structure may even be erected on beaches, fire lanes and sensitive environmental areas with little or no damage to the environment. Further, the structure does not penetrate or otherwise gouge the land when set up and during the erection process the panels preferably rest on sandbags, which are also environmentally friendly.

One embodiment of the invention is a portable and modular target range shelter comprising: a plurality of panels; wherein the plurality of panels are modular, portable, and interconnected to erect a temporary structure. The panels are comprised of one or more materials that allow a ballistic projectile to pass through the plurality of panels. The materials reseal and automatically fill up a ballistic hole after the ballistic projectile has passed through the panels such that damage to the panels is minimized. The panels are preferably comprised of two outer layers and an inner layer. The two outer layers are thin layers of metal and the inner layer is plastic foam. The panels are further comprised of one or more interior support rails, which are enclosed within the two outer layers and provide rigid support to the panels. The interior support rails are comprised of rigid high density polyurethane foam that allows a ballistic projectile to pass through the support rails with minimal damage to the support rails.

Preferably the ballistic projectile that passes through the panels is not scattered, splashed back, or ricocheted when passing through the panels. The erected temporary structure or expendable facade is used as a background for one or more range targets. The panels are replaceable and interchangeable in the erected temporary structure. Preferably the two outer layers of the panels are thin layers of galvanized aluminum (or galvanized steel (preferably 24-26 gauge)) and the inner layer is polyurethane foam that is injected under high pressure between the two outer layers. If any large holes are made by the ballistic projectile that do not reseal and automatically fill up with the polyurethane foam, these are easily repaired with a sealing substance.

Preferably the range shelter has side panels, one or more roof panels, one or more floor panels, and one or more floor blocks. The floor panels rest on the floor blocks and the floor panels do not touch the surface upon which the temporary structure is erected. This minimizes environmental damage. Preferably the ends and sides of the roof panels are flush with the side panels such that the roof panels do not project or overhang beyond an outside edge of the side panels. Preferably the wall, roof, and floor panels are standardized and interchangeable with each other for ease of setting up. The side panels may be a solid wall panel, a window panel, corner panel, or a door panel. The panels are interconnected using one or more cam-locks which are operated with a hex wrench.

The panels allow a ballistic (or other projectile) to pass through with minimal damage to the panels, and the high density foam preferably automatically fills up small ballistic holes, and larger ballistic holes are easily repaired with a sealing substance, such as chalk, putty, Bondo®, or silicone. The shelter also preferably includes one or more floor blocks, on which the floor panels rest such that the floor panels do not touch a ground. The roof preferably fits seamlessly with the walls and does not over hang the outside skin of the wall. The wall, roof, and floor panels are preferably standardized and interchangeable, such that shelters of any shape and size are constructed and erection and strike of the shelters are easy and fast. Preferably, the panels are easily replaced, even if the shelter is completely erected. The wall panels preferably come in four basic types, a solid flat wall, a corner, a window, and a door. The panels are preferably connected, or interlocked with a cam-lock, which is controlled with a hex wrench.

The panels of the invention are designed to go on board ship to be used by the United States Marie Corps Marine Expeditionary Units to set up expendable facades for training in host countries. These temporary structures provide a significant cost savings, are easier to clean up, and reduce environmental damage over the presently available range target shelters. The primary use of the modules will be on live fire ranges which are environmentally sensitive therefore the sustainable aspects of the product make it environmentally friendly. There are no noxious fumes and no hazmat requirements with cleanup. When a panel has been saturated with bullet holes (approximately 50,000 per panel) the panel is simply recycled (or placed in a landfill as polyurethane is a landfill approved material) and replaced with a new panel.

Another embodiment of the invention is a method for erecting a portable and modular target range shelter, comprising the steps of: providing one or more wall panels, one or more floor panels, and one or more roof panels; wherein the panels comprise two outer galvanized aluminum layers and an inner polyurethane layer; and wherein the panels allow a ballistic to pass through the panels with minimal damage; combining the panels to erect a shelter that has a floor, two or more walls, and a roof; wherein the panels are connected with a cam-lock mechanism; elevating the shelter such that the floor does not rest on a ground; replacing one or more damaged panels of the shelter; repairing one or more ballistic holes of the shelter; and interchanging the panels to erect a larger or smaller shelter.

It is an object of the present invention to provide a target range shelter that overcomes the limitations of the prior art.

Another object of the invention is to provide a target range shelter that is lightweight, easily transportable, modular, and easy to assemble or erect.

Another object of the invention is to provide an inexpensive and easy to dispose of target range shelter.

It is another objection of the invention to provide a realistic structure or expendable facade that can be a background to one or more range targets that are fired at by live ammunition.

Another object of the invention is to provide a target range shelter that when shot at with live ammunition allows the ammunition to pass a through with minimal damage to the shelter and with no scatter or splashback from the bullets or other projectiles. The invention allows for a safer target shooting environment due to the lack of ricocheting bullets.

Another object of the invention is to provide a target range shelter that is fire resistant.

Other features and advantages are inherent in the modular shelter disclosed will become apparent to those skilled in the art from the following detailed description and its accompanying drawings.

DETAILED DESCRIPTION OF THE DRAWINGS

In the following detailed description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

Polyurethane foam, a material that is well known in the art, ranges in both stiffness and density. The stiffness ranges from flexible to rigid. Flexible is used for such household items as bedding or shoe insert foam and rigid is used for those applications, such as insulation, carving foam, or solid plastics, which require a stiffer substance. The density ranges include low (6 kg/m$^2$), high (400 kg/m$^2$), microcellular (800 kg/m$^2$), and solid elastomer (1200 kg/m$^2$). Preferably, the present invention uses one or more rigid high density foams that may be sprayed into a form using a high pressure foam sprayer. The rigid high density polyurethane foam interior support rails discussed below simulate a wooden support rail, but are lighter and less flammable. Polyurethane is a landfill approved material in many countries and can be recycled. The polyurethane foam used in the present invention preferably has a density and stiffness that allows a bullet or other projectile to pass through and then expand to fill in the hole that was left by the bullet.

Although polyurethane foam is the preferred material used to provide the resealing range shelter of the present invention, any substance, including other plastics or plastic foams that reseal themselves may be used.

Figure 1:
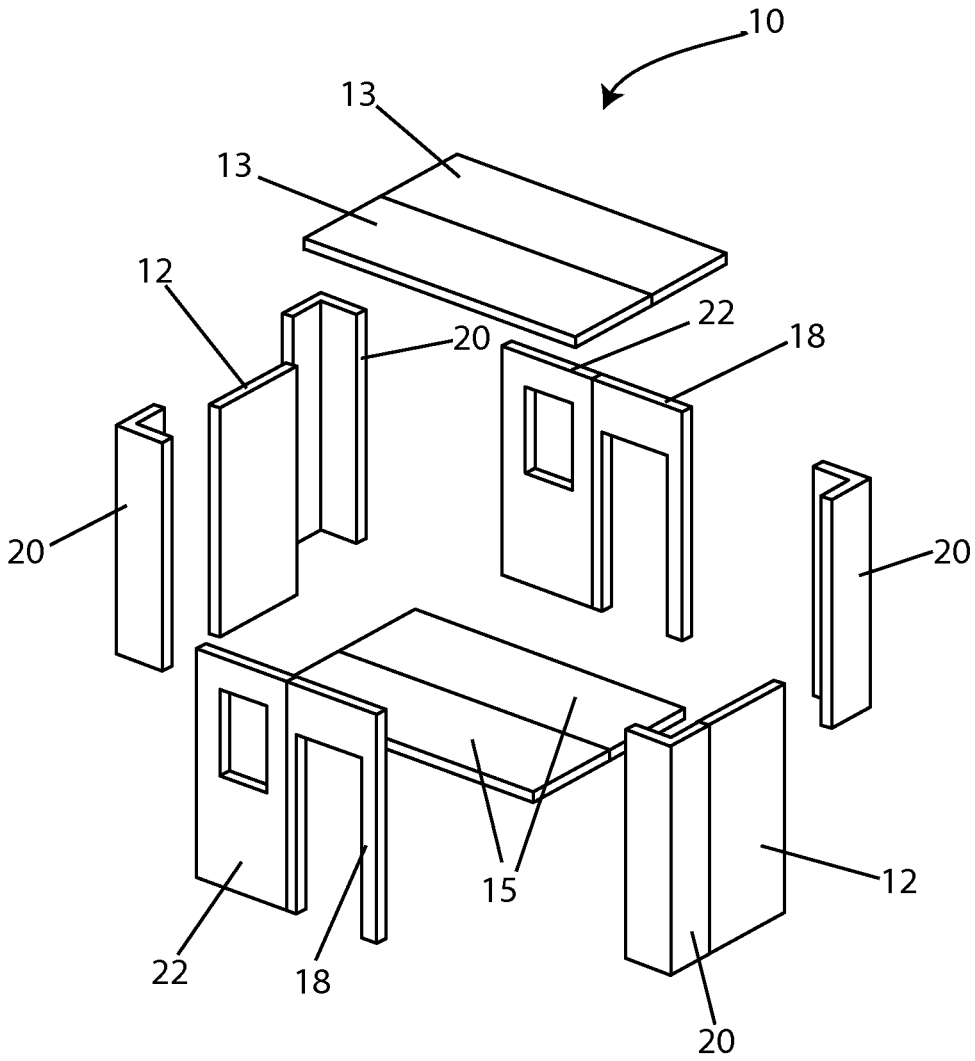
FIG. 1 is an illustration of an exploded view of one embodiment of the portable and modular target range shelter.

FIG. 1 is an illustration of an exploded view of one embodiment of the portable and modular target range shelter. As shown in FIG. 1, shelter 10 is preferably comprised of wall panels 12, roof panels 13, floor panels 15, door panels 18, corner panels 20, window panels 22. Although FIG. 1 shows the modular shelter as a small one story shelter, the invention may be as large as a complex multi-storied office building made from thousands of panels, or as small as two interconnected panels. FIG. 1 also shows how, with the exception of the corner panels, the panels are all preferably standardized such that any panel may be connected to any other panel. This standardization makes transportation, erection, and striking of the shelter easy and fast. This standardization also makes the panels more interchangeable so that shelters of any size can be built. This interchangeability also allows damaged panels to be easily swapped out for new panels. The panels preferably have a high structural integrity per weight in order to withstand high compression, transverse, and racking loads.

The corner panels 20, as shown in FIG. 1, are not necessary to the assembly of the present invention. The interchangeable, and preferably not bent roof, wall, and floor panels may be interconnected at any angle (from 1 degree to 179 degrees) to form a corner. Not requiring the use of corner panels 20 has the added benefit of having all of the panels be essentially flat and, thus, easier to transport.

Figure 2:
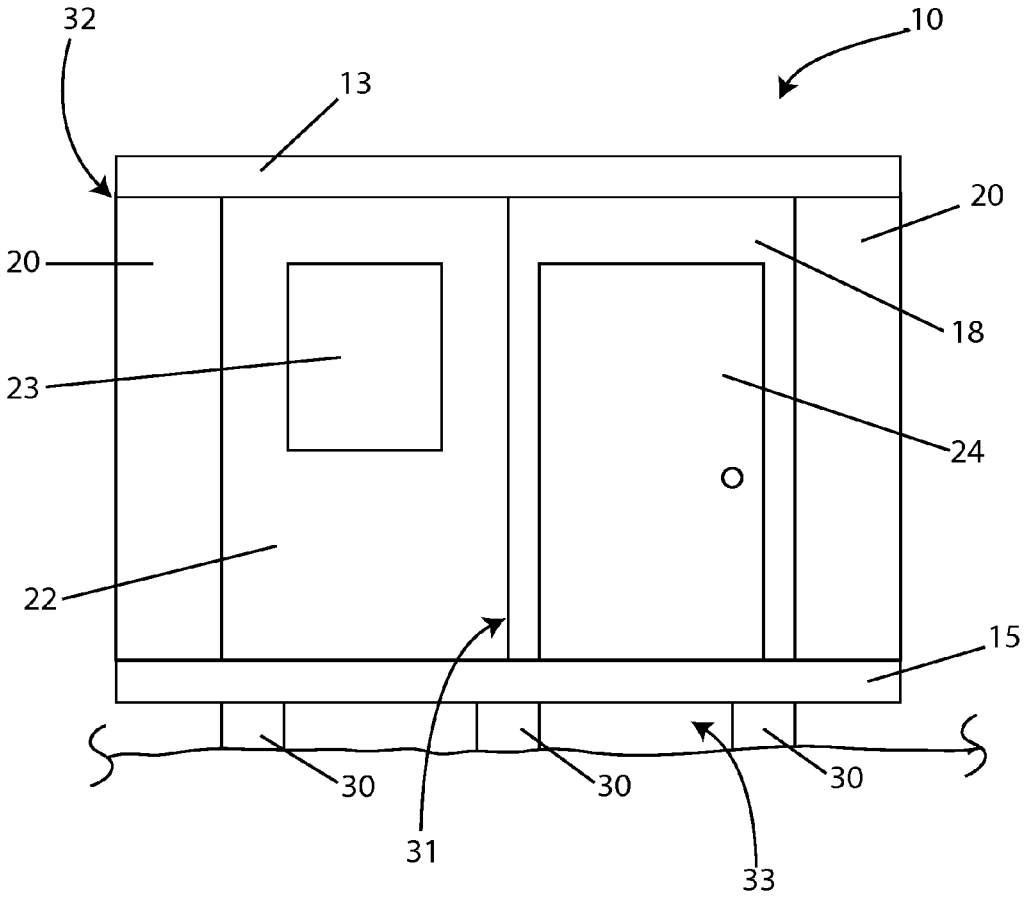
FIG. 2 is an illustration of a front view of one embodiment of the portable and modular target range shelter.

FIG. 2 is an illustration of a front view of one embodiment of the portable and modular target range shelter. As shown in FIG. 2, shelter 10 preferably includes roof panels 13, floor panels 15, door panels 18, corner panels 20, window panels 22, window 23, door 24, floor blocks 30, connection seam 31, flush seam 32, and crawl space 33. FIG. 2 shows the invention completely erected. FIG. 2 shows how the panels, when connected are flush with each other, see connection seam 31 and flush seam 32, such that there is no overhang between any two panels. It is important to the environment that the roof panels not overhang the outside skin of the wall panels, because any overhang may be used as a shade nest for wild life. Because the modular shelter is temporary, any nesting animals would necessarily have to be displaced when the shelter is taken down.

FIG. 2 shows how the completed shelter is preferably at least 5 centimeters off of the ground. Although paving stones are the preferred supporting blocks, any blocks, bricks, concrete, supporting structures, plastic bricks, sandbags or stones may be used to level and support the modular shelter of the present invention. Having the shelter put on blocks or sandbags helps prevent the shelter from killing all of the plants underneath of the shelter and leaving a footprint behind after the shelter is removed.

Figure 3:
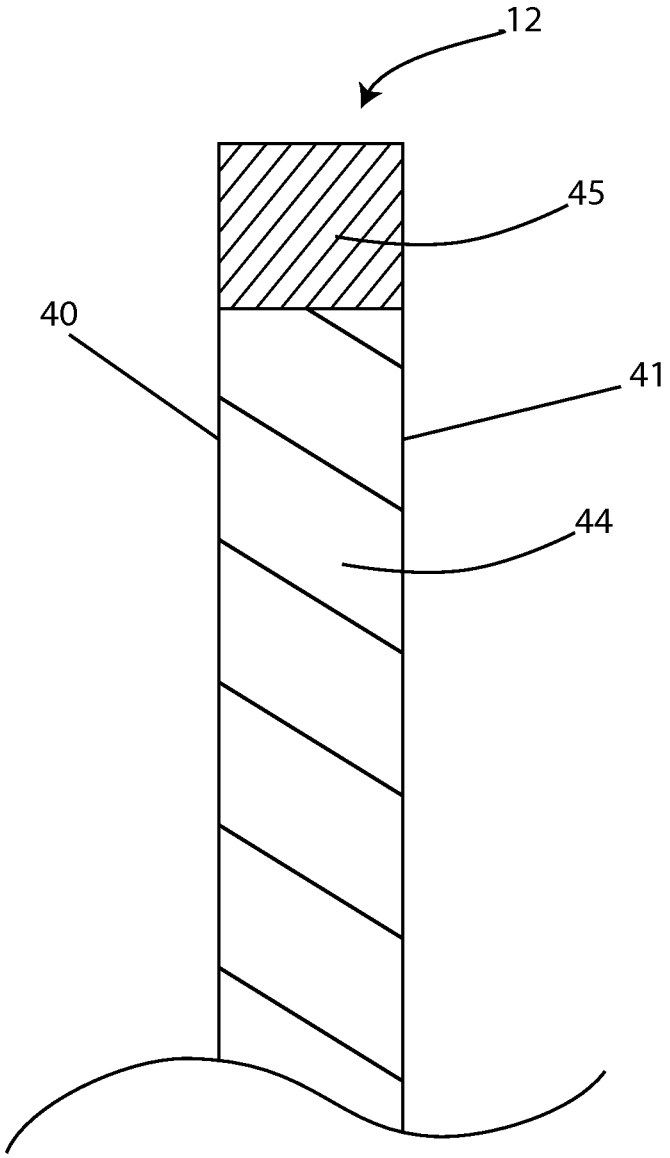
FIG. 3 is an illustration of an interior view of a modular panel of one embodiment of the portable and modular target range shelter.

FIG. 3 is an illustration of an interior view of a modular panel of one embodiment of the portable and modular target range shelter. As shown in FIG. 3, the panels, in this case, wall panel 12, preferably includes, two outer layers 40 and 41, inner layer 44, and interior support rail 45. Inner layer 44 is preferably polyurethane foam, which has excellent adhesive properties and when it is injected between the outer layers 40 and 41, which are the skin of the panels, the foam adheres and bonds to every surface within the panel. Other structures that may be in the panel include substrates, top-plates, splines, cam-locks, electrical boxes, and interior support rail 45. After adhering to the surfaces, the foam becomes rigid and a strong and durable bond exists between the polyurethane foam and the two outer layers 40 and 41. The two skins or outer layers 40 and 41 are typically thin layers of metal and preferably galvanized aluminum or galvanized steel. Galvanized aluminum and galvanized steel is both very light and very strong, and does not cause the ballistic projectiles, or bullets, that are fired at the panels to scatter, splashback, or ricochet. Scatter and splashback are interchangeable terms referring to a bullet or other projectile fragmenting and being redirected at the person firing the projectile or another person nearby. The galvanized aluminum is also easy to repair, as discussed below. Heat and pressure created by the chemical reaction of the expanding polyurethane foam forces complete adhesion of the foam core to the skins. A polyurethane panel acts as an excellent insulator.

Polyurethane does not melt at any temperature. It will withstand constant service temperatures up to 180-degrees Fahrenheit and will not char up to 275-degrees Fahrenheit. Preferably the polyurethane used has a Fire Rating of American Society of Testing and Materials (ASTM) E84-04, and is a Class 1 Foam Core.

As shown in FIG. 3, the panels of the present invention preferably have interior support rails 45 that run along the edges of the panel. This also makes a waterproof seal on the edges and provides rigid support for the injection of the polyurethane foam and the easy and safe transportation of the panel. Preferably interior support rail 45 is made from a preformed and rigid high density polyurethane.

When the panels, as preferred, have a polyurethane foam inner layer 44, high density polyurethane interior support rails 45, and aluminum or steel outer layers 40 and 41, the final panel is very strong and very light weight. Additionally, because there is minimal amount of hard metal (i.e. iron, steel, etc.) or wood in the panel the panel is fire resistant and will allow a ballistic projectile to pass through without causing ricochet, scatter, splashback, fragmentation, kickback, or destruction of the projectile and with only causing minimal damage to the panel.

The panels are preferably light enough to allow two people to erect a basic modular shelter.

Figure 4:
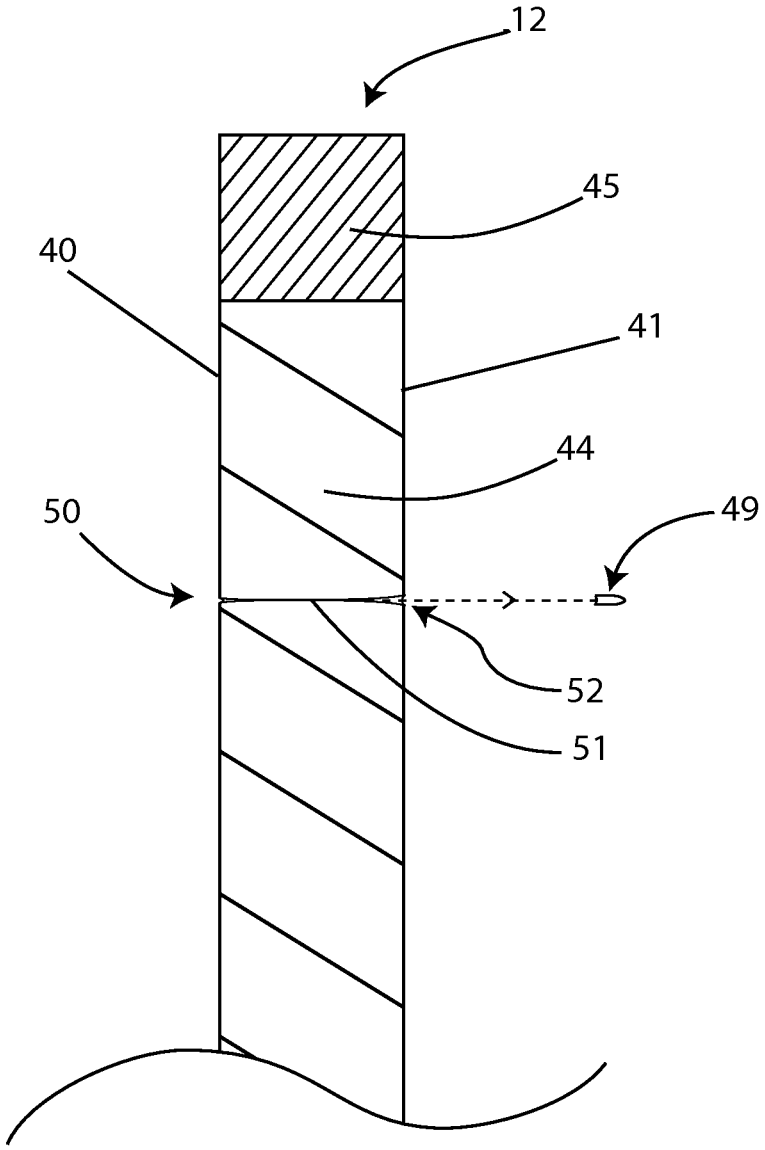
FIG. 4 is an illustration of an interior view of a modular panel of one embodiment of the portable and modular target range shelter and shows a ballistic projectile going through the modular panel.

FIG. 4 is an illustration of an interior view of a modular panel of one embodiment of the portable and modular target range shelter and shows a ballistic projectile going through the modular panel. As shown in FIG. 4, the panels, in this case, wall panel 12, preferably includes, two outer layers 40 and 41, inner layer 44, and interior support rail 45. FIG. 4 also shows how the inner layer 44 reseals itself as the polyurethane foam expands to fill in the hole 51 left by bullet 49 (which is an example of a ballistic projectile). FIG. 4 also shows how the panels of the present invention allow a ballistic to pass as cleanly as possibly through. This is important for extending the useful life of the modular shelter and to prevent damage to the environment from pieces of the panels or bullets shattering, splashing back, and scattering throughout the target range. FIG. 4 specifically shows how a ballistic, rather than causing the panel to explode or fragment, merely passes through the panel, leaving the panel essentially intact. However, FIG. 4 also shows that, depending on the caliber or size of the bullet, an entry gouge 50 and exit gouge 52 may be left by the passing bullet 49. FIG. 4 shows how the bullet 49 passes cleanly through without scattering, splashing back, ricocheting, or otherwise being destroyed or redirected.

Figure 5:
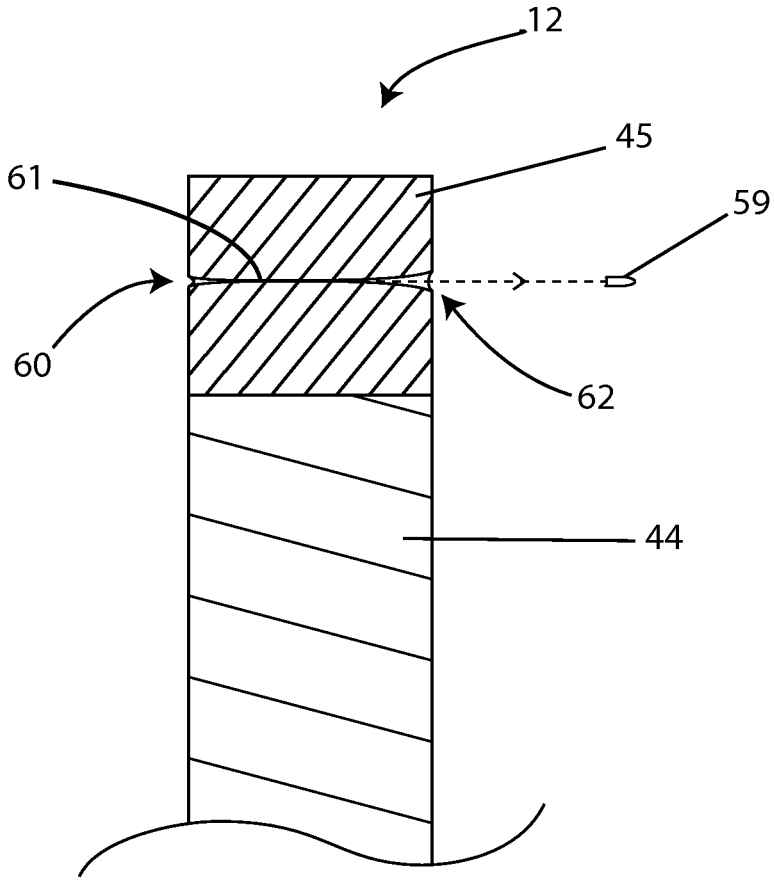
FIG. 5 is an illustration of an interior view of a modular panel of one embodiment of the portable and modular target range shelter and shows a ballistic projectile going through the interior support rail of the modular panel.

FIG. 5 is an illustration of an interior view of a modular panel of one embodiment of the portable and modular target range shelter and shows a ballistic projectile going through the interior support rail of the modular panel. FIG. 5 shows that wall panel 12 preferably includes inner layer 44 and interior support rail 45, which is preferably made from a rigid high density poly urethane foam. As shown in FIG. 5, interior support rail 45 allows bullet 59 to pass through and only leave a small hole 61, which is self sealing. Although the rigid high density polyurethane foam typically has a larger entry gouge 60 and exit gouge 62 than is left if the ballistic projectile passes through the less rigid polyurethane foam that is preferably in the inner layer 44. FIG. 4 shows how the bullet 59 passes cleanly through without scattering, splashing back, ricocheting, or otherwise being destroyed or redirected.

Figure 6:
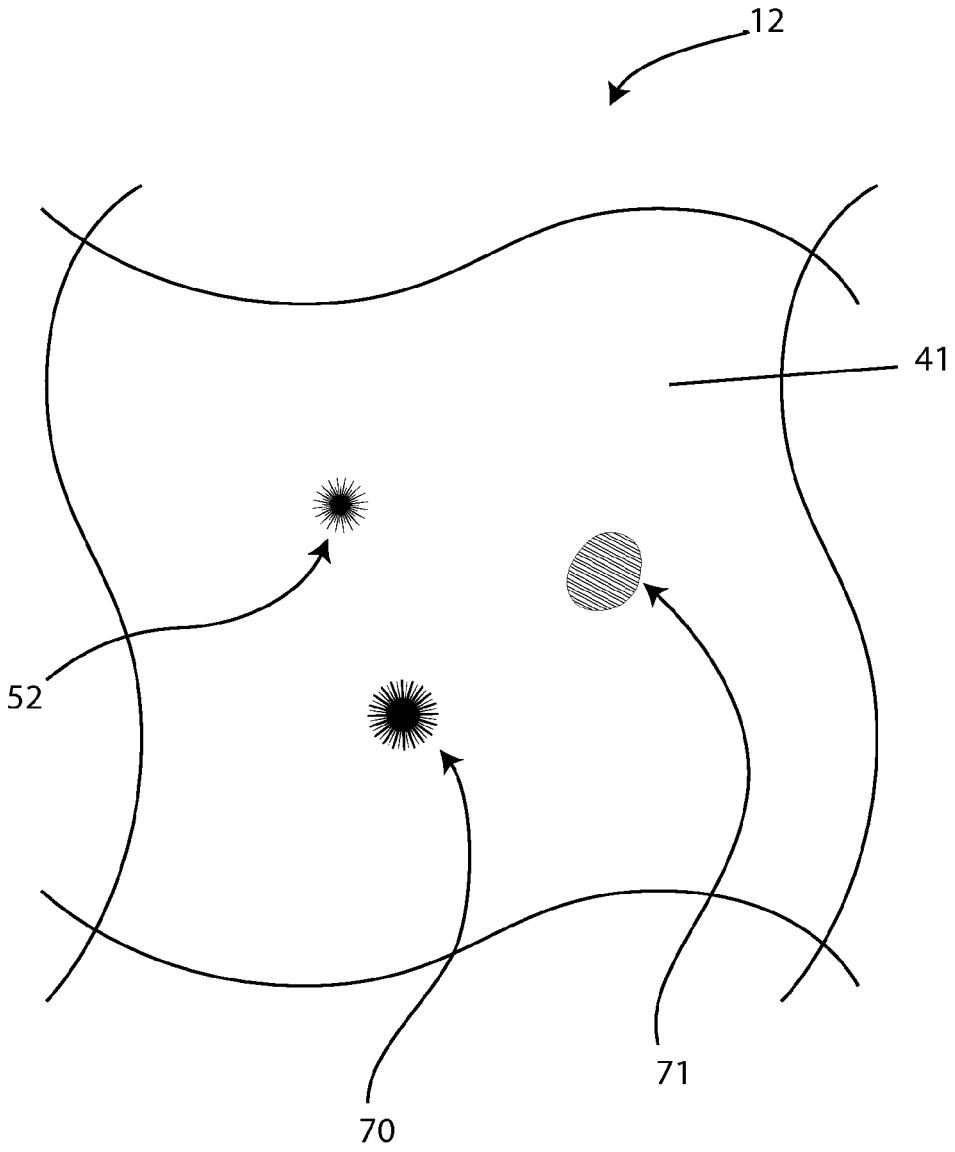
FIG. 6 is a close-up illustration of one embodiment of a panel and shows how larger ballistic holes are easily patched with a sealant.

FIG. 6 is a close-up illustration of one embodiment of a panel and shows how larger ballistic holes are easily patched with a sealant. As shown in FIG. 6, wall panel 12 has three exit gouges 52, 70 and 71 in the outer layer 41 (or skin). Exit gouge 52 is a small, un-patched gouge that was left by bullet 49 (as shown in FIG. 4). Exit gouge 70 is a larger exit gouge that was left by a larger bullet. Exit gouge 71 shows a hole that has been patched with a sealant. The sealant may be any sealant, such as liquid Bondo®, silicon, caulk, glue, paint, putty, paste, or gel, which can fill a hole and then harden. FIG. 6 shows how the bullets pass easily through the panels and that repairing the panels is easy and quick.

Figure 7:
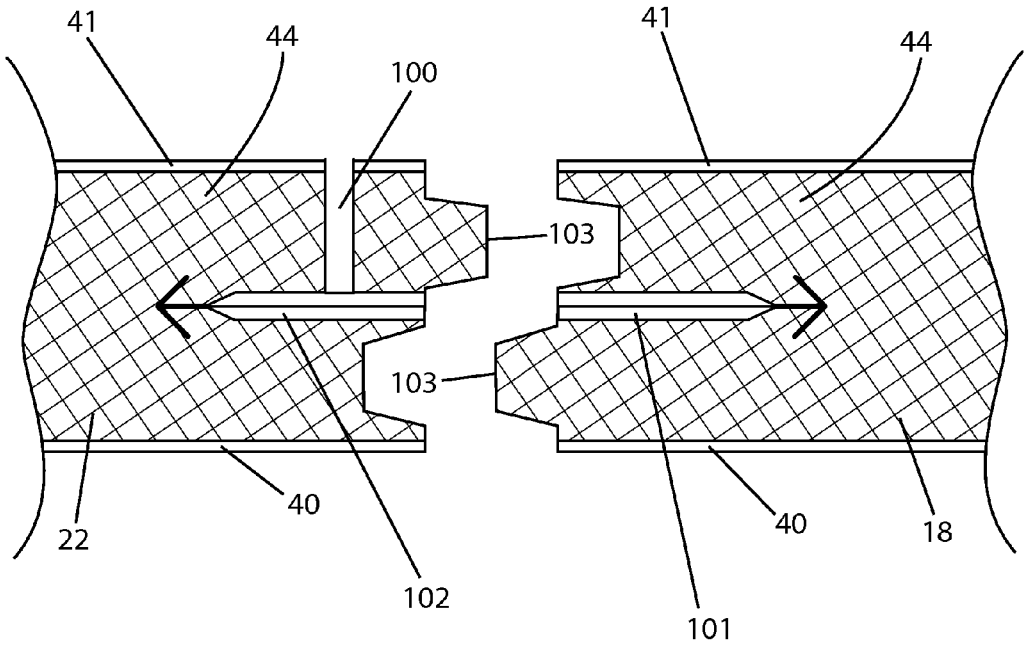
FIG. 7 is an illustration of an interior view of how the panels are connected via a cam-lock.

FIG. 7 is an illustration of an interior view of how the panels are connected via a cam-lock. The sides of the panels, in this case window panel 22 and door panel 18, are preferably connected by cam-locks that are placed along the edges of the panels. FIG. 7 shows that window panel 22 and door panel 18 preferably include inner layers 44, outer layers 40 and 41, cam-lock key hole 100, male cam-lock 102, female cam-lock 101, and aluminum tongue and groove frames 103. When the sides of the panels are joined together, the male cam-lock 102, female cam-lock 101, and aluminum tongue and groove frames 103 matingly engage with each other. The user then uses a hex key to latch the cam-lock, which holds the panels together. Having a cam-lock latch allows the user to minimize the tools that are needed for set up and break down and still have a sturdy latching mechanism. The cam-lock is a quick release latching mechanism that is well known in the art.

Although the cam-lock is the preferred latching mechanism, it should be understood that any latching or joining mechanism can be used including, but not limited to: straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, solder, weld, or ultrasonic welding.

Figure 8:
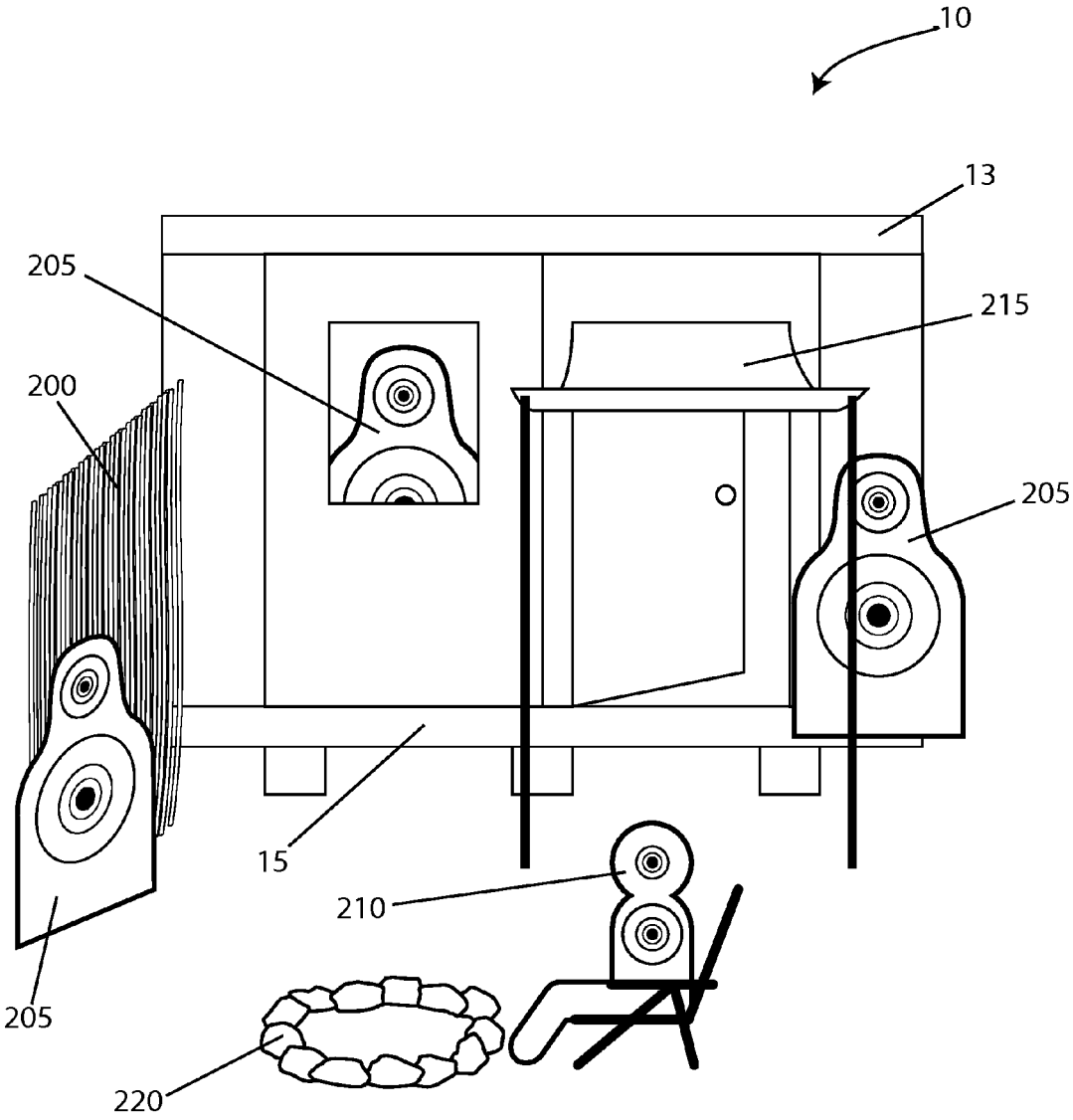
FIG. 8 is an illustration of a front view of one embodiment of the portable and modular target range shelter and shows the shelter being used as a background for live ammunition range targets.

FIG. 8 is an illustration of a front view of one embodiment of the portable and modular target range shelter and shows the shelter being used as a background, or expendable facade, for live ammunition range targets. The preferred use of the invention is to serve as a background for live ammunition range targets. FIG. 8 shows structure 10 set up to look like a storefront with body targets 205 and 210, fire pit 220, fence 200, awning 215, roof panel 13, and floor panel 15. A user firing at the targets 205 and 210 would be able to freely fire and not worry about scattering, splashing back, or ricochets. Additionally, the targets could be set up again and again without having to fix structure 10 because the bullets and other projectiles fired would merely pass through the panels rather than destroying them. The present invention is a vast improvement over a plywood shack, because the plywood is heavier, harder to set up, easily damaged, would spray splinters everywhere, would scatter/splashback the bullets, might catch on fire, and would need to be cleaned up or replaced after a few hours of target practice.

FIG. 8 also shows how the modular shelter 10 is versatile and can be easily decorated to look like any kind of a building, including a home, a military or police facility, or a factory.

Although the invention has been described above in relation to preferred embodiments, it will be understood by those skilled in the art that variations and modifications can be effected in these preferred embodiments without departing from the scope and spirit of the invention.

In summary, the present invention is a modular and portable range target structure that is made from panels that allow a bullet to pass through with minimal damage to the panel and without scattering or splashing back the bullet.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A portable and modular target range shelter comprising:

a plurality of panels;

wherein said plurality of panels are modular and portable;

wherein said plurality of panels are interconnected to erect a temporary structure;

wherein said plurality of panels are comprised of two outer layers and an inner layer;

wherein said two outer layers are thin layers of metal and wherein said inner layer is a polyurethane foam that is injected under high pressure between said two outer layers;

wherein said temporary structure is located on a target range;

wherein a plurality of bullets are fired at said temporary structure and substantially all of said plurality of bullets that strike said temporary structure pass entirely through said plurality of panels;

wherein said plurality of bullets that passes entirely through said plurality of panels are not scattered or ricocheted when passing through said plurality of panels;

wherein said polyurethane foam of said plurality of panels reseals and automatically fills up a plurality of bullet holes after one of said plurality of bullets has passed entirely through said plurality of panels such that damage to said plurality of panels is minimized.

2. The portable and modular target range shelter of claim 1, wherein said plurality of panels are further comprised of one or more interior support rails;

wherein said interior support rails are enclosed within said two outer layers and provide rigid support to said plurality of panels; and wherein said interior support rails are located at one or more edges of said plurality of panels.

3. The portable and modular target range shelter of claim 2, wherein said one or more interior support rails are comprised of rigid high density polyurethane foam;

wherein said one or more rigid high density polyurethane foam interior support rails allow said plurality of bullets to pass through said one or more high density polyurethane foam interior support rails with minimal damage to said one or more high density polyurethane foam interior support rails.

4. The portable and modular target range shelter of claim 3, wherein when said temporary structure is a background for one or more range targets.

5. The portable and modular target range shelter of claim 4, wherein said plurality of panels are replaceable and interchangeable in said temporary structure.

6. The portable and modular target range shelter of claim 5, wherein said two outer layers of said plurality of panels are thin layers of galvanized aluminum.

7. The portable and modular target range shelter of claim 6, wherein one or more larger holes made by said bullets that do not reseal and automatically fill up with said polyurethane foam are easily repaired with a sealing substance.

8. A portable and modular target range shelter of claim 7, wherein said plurality of panels include a plurality of side panels, one or more roof panels, and one or more floor panels.

9. The portable and modular target range shelter of claim 8, further comprising:

one or more floor blocks;

wherein said floor panels rest on said one or more floor blocks and wherein said floor panels are at least approximately 5 centimeters above a surface upon which said temporary structure is erected.

10. The portable and modular target range shelter of claim 9, wherein one or more ends and one or more sides of said roof panels are flush with said plurality of side panels such that said roof panels do not project or overhang beyond an outside edge of said plurality of panels.

11. The portable and modular target range shelter of claim 10, wherein said wall, roof, and floor panels are standardized and interchangeable with each other.

12. The portable and modular target range shelter of claim 11, wherein said wall panels are selected from the group consisting of a solid wall panel, a window panel, corner panel, or a door panel.

13. The portable and modular target range shelter of claim 12, wherein said plurality of panels are interconnected using one or more cam-locks and wherein said one or more cam-locks are operated with a hex wrench.

14. The portable and modular target range shelter of claim 13, wherein said sealing substance is liquid putty.

15. The portable and modular target range shelter of claim 13, wherein said sealing substance is silicon.

* * * * *